US008006870B2

(12) United States Patent
Stadelhofer et al.

(10) Patent No.: US 8,006,870 B2
(45) Date of Patent: Aug. 30, 2011

(54) DISCHARGER FOR A FLOWABLE MEDIUM

(75) Inventors: Peter Stadelhofer, Singen (DE); Juergen Greiner-Perth, Gottmadingen (DE); Miro Cater, Daytona Beach, FL (US)

(73) Assignee: Ing. Erich Pfeiffer GmbH, Radolfzell (DE)

( * ) Notice: Subject to any disclaimer, the term of this patent is extended or adjusted under 35 U.S.C. 154(b) by 1201 days.

(21) Appl. No.: 11/716,982

(22) Filed: Mar. 12, 2007

(65) Prior Publication Data

US 2007/0210114 A1 Sep. 13, 2007

(30) Foreign Application Priority Data

Mar. 13, 2006 (DE) ..... 10 2006 012 898

(51) Int. Cl.
*B65D 37/00* (2006.01)
*B65D 88/54* (2006.01)

(52) U.S. Cl. ..... 222/207; 222/213; 222/340

(58) Field of Classification Search ..... 222/383.1, 222/340, 256, 207, 212, 213, 214, 209
See application file for complete search history.

(56) References Cited

U.S. PATENT DOCUMENTS

| | | | | |
|---|---|---|---|---|
| 3,369,706 | A | 2/1968 | Schnyder | |
| 3,751,536 | A | 8/1973 | Bourat et al. | |
| 4,655,690 | A * | 4/1987 | Boedecker et al. | 417/53 |
| 4,732,549 | A * | 3/1988 | von Schuckmann | 417/472 |
| 4,863,070 | A * | 9/1989 | Andris | 222/207 |
| 4,915,601 | A * | 4/1990 | von Schuckmann | 417/472 |
| 4,971,470 | A | 11/1990 | Moeck et al. | |
| 5,014,881 | A * | 5/1991 | Andris | 222/207 |
| 5,385,302 | A * | 1/1995 | Foster et al. | 239/333 |
| 5,425,482 | A * | 6/1995 | Foster et al. | 222/207 |
| 5,509,608 | A * | 4/1996 | Foster et al. | 239/333 |
| 5,518,147 | A * | 5/1996 | Peterson et al. | 222/153.07 |
| 5,551,636 | A * | 9/1996 | Foster et al. | 239/333 |
| 5,553,752 | A * | 9/1996 | Foster et al. | 222/340 |
| 5,664,703 | A * | 9/1997 | Reifenberger et al. | 222/207 |
| 5,829,640 | A * | 11/1998 | Hershey et al. | 222/153.13 |
| 6,123,234 | A | 9/2000 | Lai | |
| 6,460,738 | B1 | 10/2002 | Petit | |

(Continued)

FOREIGN PATENT DOCUMENTS

EP 1 170 061 A2 1/2002

(Continued)

OTHER PUBLICATIONS

European Patent Office Search Report dated Jun. 19, 2009 (6 pages).

*Primary Examiner* — Kevin P Shaver
*Assistant Examiner* — Stephanie E Williams
(74) *Attorney, Agent, or Firm* — Flynn, Thiel, Boutell & Tanis, P.C.

(57) ABSTRACT

A discharger for a flowable medium, having a pumping device with a pumping chamber which is closed off on one side by a longitudinally movable piston, is provided.
The pumping chamber on the piston side is hermetically sealed against an environmental atmosphere outside the discharger by a gas-impermeable and at least partially flexible diaphragm, and the diaphragm, in its marginal region, is fixedly connected to a housing of the discharger.
The discharger is used for high sealing requirements against the ingress of impurities.

8 Claims, 4 Drawing Sheets

U.S. PATENT DOCUMENTS

| | | | | |
|---|---|---|---|---|
| 6,527,144 | B2 | 3/2003 | Ritsche et al. | |
| 6,527,202 | B1 * | 3/2003 | Tseng | 239/333 |
| 6,543,653 | B2 | 4/2003 | Lamboux | |
| 6,712,243 | B2 * | 3/2004 | Rossignol | 222/207 |
| 2002/0008122 | A1 | 1/2002 | Ritsche et al. | |
| 2002/0134798 | A1 | 9/2002 | Lamboux | |

FOREIGN PATENT DOCUMENTS

| | | |
|---|---|---|
| FR | 2 632 545 | 12/1989 |
| FR | 2 794 727 | 12/2000 |
| WO | WO 01/44076 A2 | 6/2001 |

* cited by examiner

DISCHARGER FOR A FLOWABLE MEDIUM

FIELD OF THE INVENTION

The invention relates to a discharger for a flowable medium, having a pumping device comprising a pumping chamber which is closed off on one side by a longitudinally movable piston.

BACKGROUND OF THE INVENTION

Dischargers of the generic type serve for the discharge of cosmetic or pharmaceutical mediums. These are conveyed from a medium store by actuation of the pump and are discharged into an environment through a discharge opening. The pumping process is generally triggered by a manually operable actuating device, by means of which a piston in the pump is displaced. As a result, a discharge pressure is generated which forces the medium in the pumping chamber out of the discharger through the discharge opening.

It is regarded as a drawback with known dischargers that the sealing of the pumping chamber against the environment, especially in the region of the actuating device, is frequently unsatisfactory. This results in an unwanted escape of medium from the discharger and an unwanted ingress of impurities into the discharger.

SUMMARY OF THE INVENTION

The object of the invention is to improve the dischargers known from the prior art, especially with regard to the sealing of the pumping chamber.

This object is achieved by a discharger of the generic type in which the pumping chamber, on the piston side, is hermetically sealed against an environmental atmosphere outside the discharger by means of a gas-impermeable and at least partially flexible diaphragm, the diaphragm, in its marginal region, being fixedly connected to a housing of the discharger.

The diaphragm is preferably configured as a thin plastics layer. It is elastic in order that, when clamped fixedly to the housing by its marginal region, it can still follow the stroke movement of an actuating device and of the piston. Compared with the dischargers known from the prior art, in which the actuating device and the piston are mounted relative to the housing of the discharger by means of sliding guides, the housing-fixed clamping guarantees a secure protection from impurities, especially from microbiological impurities. As a result of the stationary clamping, a hermetic seal, in contrast to sliding and usually play-afflicted sealing surfaces, is obtainable. The marginal region is preferably clamped in place by latching or wedging means by which the marginal region is forced against a housing-side bearing surface, so that the sealing effect is given in this clamping region also. A thickening of the diaphragm in the marginal region additionally allows a stiffening to be achieved which deters the diaphragm from sliding out of the latching or locking means. As an alternative to latching and clamping means, embodiments having a bonded fastening of the marginal region of the diaphragm can also be expedient. Moreover, embodiments of the invention are also covered in which the diaphragm is integrally connected to the housing. This can be achieved by using the same material for the housing and the diaphragm, with markedly reduced wall thickness in the region of the diaphragm. Alternatively, the integrality is also obtainable with different materials, however, using a two-step injection process. As a material combination, PP for the housing and TPE for the diaphragm, for example, is an option. The fixed connection of the diaphragm to the housing does not need to be made in the region of the outer surface. By housing should be understood, in connection with the invention, housing-fixed components. In particular, the housing also comprises the inner wall of the pumping chamber, which does not need to be configured in one piece with an outer surface of the housing.

In one refinement of the invention, the diaphragm is connected to an actuating device operatively connected to the piston. Particular preference is for a one-piece design. The marginal region of the diaphragm is here preferably secured to the outer wall of the housing, for example wedged in place in an outward-facing groove on the housing surface. The connection to the actuating device is preferably made integrally, so that the actuating device is produced from the same material as the diaphragm and acquires the necessary stability through a corresponding greater material thickness. Alternatively thereto, the diaphragm can also, however, be provided as a separate component, which fully covers the actuating device in the manner of a protective cover.

In one refinement of the invention, the diaphragm is connected to the piston. Particular preference is for a one-piece design. In this refinement, the pumping chamber is directly closed off by the elastic diaphragm, so that the change in volume of the pumping chamber in the course of the actuation is obtained via the elastic deformation of this diaphragm. The diaphragm is in this case preferably fastened to the pumping chamber wall. One advantage with such an embodiment is that even impurities which infiltrate the discharger at places other than at the actuating device cannot get into the pumping chamber. In a particularly advantageous embodiment of this refinement, the marginal region of such a diaphragm simultaneously forms the bearing surface for a restoring spring of the actuating device, so that the restoring spring, apart from the task of forcing the actuating device back into the initial position, also fulfills the task of pressing the diaphragm against its bearing surface, so that a very good seal is obtained in the marginal region of the diaphragm.

In one refinement of the invention, the diaphragm is provided as a separate component between the piston and the pumping chamber.

In one refinement of the invention, the piston is longitudinally movable in a piston direction which forms a right angle with a principal direction of extent of the discharger. In such dischargers in which the pumping and actuating direction runs perpendicular to a principal direction of extent of the discharger, the invention can be realized very simply and inexpensively. This is founded, above all, in the fact that the diaphragm is not disposed on a side of the pumping chamber which faces a medium store and does not therefore, as a result of its position, hinder the supply of the medium into the pumping chamber.

In one refinement of the invention, an inlet duct and/or an outlet duct are disposed in the pumping chamber on the side facing away from the piston. This allows a particularly advantageous supply and evacuation of the medium into and out of the pumping chamber, especially in such embodiments in which the diaphragm is disposed separately or as part of the piston in a prescriptively correct manner within the pumping chamber. In these embodiments in which the diaphragm is disposed in the pumping chamber, the problem that a supply of medium at a lateral pumping chamber wall can only be realized with difficulty is thereby solved.

Embodiments are particularly preferred in which, on the piston side, an actuating element is provided which, depending on the piston position, is operatively connected to the inlet duct or the outlet duct, the operative connection comprising, in particular, an opening or closing of the inlet duct or of the outlet duct. The purpose of such a configuration lies in the fact that the piston, depending on its position, can prevent a supply or evacuation of the medium into and out of the pumping chamber. This is advantageous above all on the basis that, in dischargers according to the invention in which the piston or a piston-fixed diaphragm is fixed to the side wall of the pumping chamber, a normal controlling of the outflow and inflow via inlets or outlets provided on a lateral pumping chamber wall is not practicable.

A particularly simple embodiment of this refinement provides that a closing pin extends in the motional direction of the piston, starting from the piston, into the piston chamber and, from a defined stroke position, by passing into the medium inlet, causes the pumping chamber to be decoupled from the medium store. From this stroke position, an onward movement of the piston produces an increase in pressure in the pumping chamber, giving rise to a discharge process.

Alternatively or additionally, the actuating element can also be used, from a second defined stroke position, to reconnect the pumping chamber to the medium store in order to provoke an abrupt drop in pressure in the pumping chamber. Such an embodiment is expedient with regard to the so-called priming, i.e. the initial filling of the pumping chamber with medium. The piston is here pushed fully into the pumping chamber until it reaches the second stroke position. In this stroke position, the compressed air escapes from the pumping chamber into the medium store or into the environment, so that, upon the return stroke, an underpressure is created which provokes the initial filling of the pumping chamber.

This is preferably realized in the course of the activation through an air outlet device for evacuating the air present in the pumping chamber, the air outlet device being disposed and configured in such a way that, upon a piston movement which reduces the volume of the pumping chamber, it is opened in a second stroke position situated beyond a first stroke position in which, in normal operation, the fluid pressure of the medium in the pumping chamber causes an outlet valve of the discharger to open.

In such a discharger, upon activation, the piston is forced into the air-filled pumping chamber until the second stroke position is reached, in which the air outlet device is opened by the piston. The compressed air is then able to escape through the air outlet device, for example to the outside or into the medium container. In the course of the return stroke, the air outlet device is reclosed directly or indirectly by the piston, so that the air cannot get back into the pumping chamber. Instead, during the return stroke, according to the embodiment of the pumping device, medium is sucked directly out of the medium container into the pumping chamber, or an underpressure is generated in the pumping chamber which, when a medium duct from the medium container to the pumping chamber is opened up by the piston, leads abruptly to the pumping chamber being filled with the medium. In the following actuations of the pumping device in normal operation, the second stroke position is not reached, or is only reached after the outlet valve of the discharger has been opened and after an associated discharge process, so that in the second stroke position no medium or only a small amount of the medium escapes through the air outlet device. The air outlet device can additionally boast a filter which, in normal operation, prevents an unwanted escape of fluid medium through the air outlet opening.

BRIEF DESCRIPTION OF THE DRAWINGS

Further advantages and features of the invention emerge from the claims and the following description of preferred illustrative embodiments of the invention, which are represented with reference to the drawings in which:

DETAILED DESCRIPTION

Figure 1:
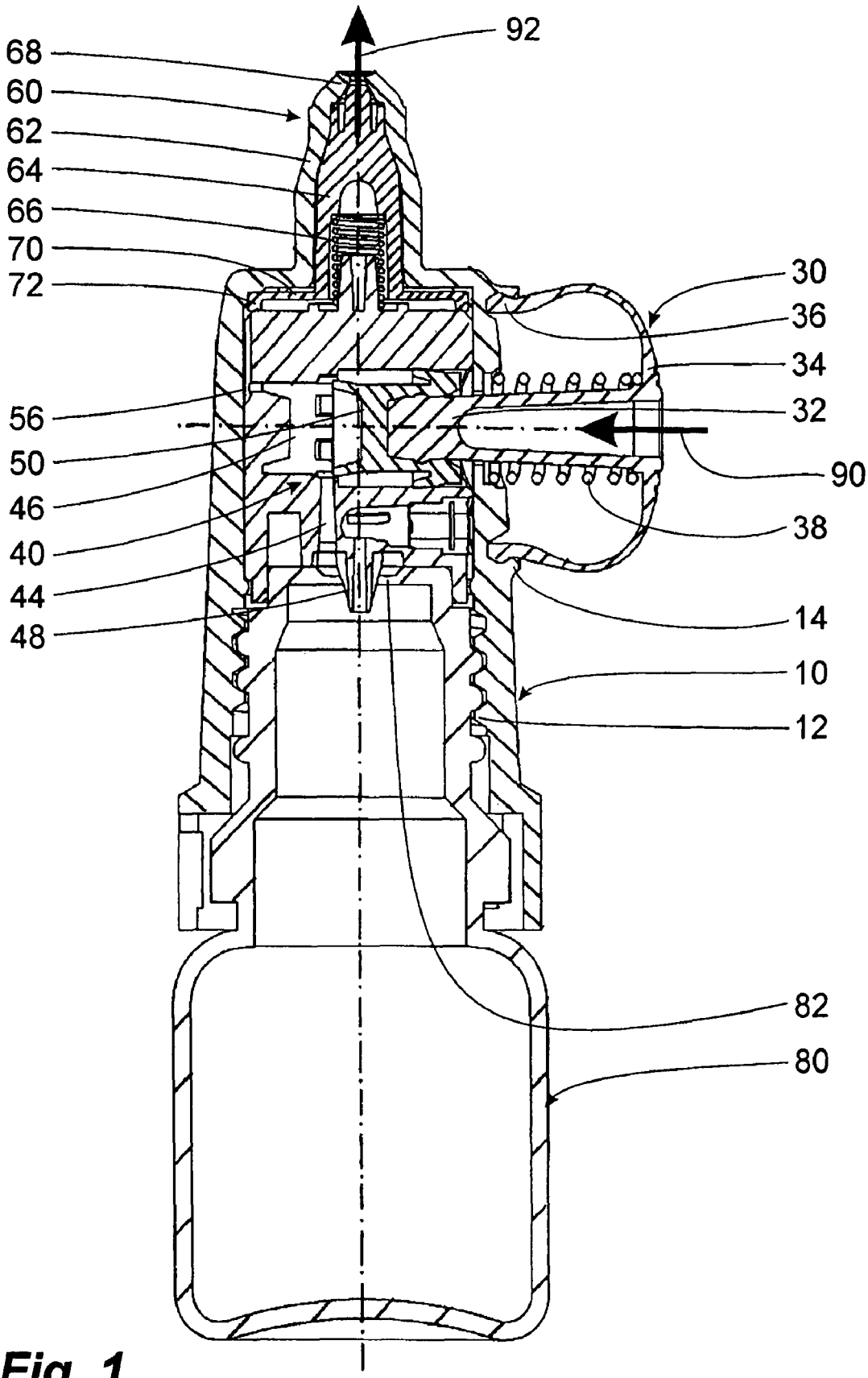
FIG. 1 shows a first embodiment of a discharger according to the invention in a sectioned representation.

FIG. 1 shows a first embodiment of a discharger according to the invention. This discharger is designed for applying a medium into an eye. As the basic principal components, it has a housing 10 comprising an actuating device 30, a pumping device 40 disposed in the housing, and a discharge valve unit 60. By means of an internal thread 12 provided on the inner wall of the housing, a medium container 80, secured by latching bosses (not described in detail) against release, is connected to the discharger.

The connection of the medium container 80 to a pumping chamber 46 of the pumping device 40 is established by an inlet duct 44, which runs into the medium container 80 within an opening mandrel 48. By means of this opening mandrel 48, a membrane 82 of the medium container 80 is pierced.

The inlet duct 44 leads into a pumping chamber 46, which is closed off on one side by a piston 50. On that side of the pumping chamber 46 which is facing away from the piston 50, an outlet duct 56 is provided, which leads to the discharge valve unit 60. The piston 50 is fixedly connected by a latching connection to a main shaft 32 of the actuating device 30. At the outer end of the main shaft 32, this merges integrally into the roughly semispherical elastic diaphragm 34. This diaphragm 34 merges at its outer end into a marginal region 36 of enlarged wall thickness, which is fixed in a housing-fixed position by a circumferential latching web 14 molded integrally onto the housing 10. The actuating device 30 is forced constantly outward by a restoring spring 38, whereby the piston 50 is drawn into a stroke limit position with the pumping chamber 46 at maximum volume. In one embodiment (not represented), a separate restoring spring is avoided by the fact that the elastic diaphragm itself applies the restoring forces.

The discharge valve unit 60 has a discharge sleeve 62 which is integrally molded onto the housing 10 and within which there is disposed a closing pin 64. If—as in the represented state—no overpressure is present in the pumping chamber 46 and in the discharge valve unit 60 connected to the pumping chamber 46 by the outlet duct 56, the closing pin 64 is forced by a closing spring 66 into the discharge sleeve 62, so that a discharge opening 68 at the distal end of the discharge sleeve 62 is sealed by the closing pin 64. On its side facing away from the discharge opening 68, the closing pin 64 has a particularly large, collar-shaped pressure plate 70, adjoined on the outside by a circumferential bearing web 72 which bears against the pumping device 40. The pressure plate 70 itself is spaced apart from the pumping device 40, the air-filled interspace being outwardly sealed by means of the bearing web 72.

When, following the activation of the discharger, the actuating device 30, in normal operation, is forced down in a pumping direction 90 by the filling of the pumping chamber 46 with the medium from the medium container 80, the diaphragm 34 deforms, the marginal region 36 remaining clamped to the housing 10. After about a third of the stroke travel, the connection of the inlet duct 44 to the pumping chamber 46 is broken by the piston 50. In the course of the further piston movement, the fluid pressure of the medium present in the pumping chamber 46, in the outlet duct 56 and in the discharge valve unit 60 is increased to the point where the pressure upon the pressure plate 70 is sufficiently high to displace the closing pin 64 counter to the spring force of the closing spring 66. Owing to the size of the pressure plate 70, a comparatively small pressure is sufficient for this purpose. The pressure plate 70 is hereupon elastically deformed by the pressure.

As soon as the closing pin 64 consequently has opened up the discharge opening 68, the medium escapes in a principal direction of extent 92 of the discharger through the discharge opening 68, whereupon, owing to the low pressure, it forms no spray jet, but instead drips are formed at the discharge opening 68.

One advantage with the discharger represented in FIG. 1 and described above is the structure, which allows comfortable and secure handling.

Particularly advantageous is the inventive hermetic encapsulation of the pumping chamber 46 from an external atmosphere as a result of the particular design of the actuating device 30 with the deformable diaphragm 34, which actively prevents contamination of the medium in the pumping chamber 46. Given the orthogonal design of the discharger, this encapsulation can be realized particularly easily, since, with respect to the arrangement, it does not come into conflict with a supply line from the medium container 80.

The hermetic encapsulation prevents both the escape into the environment of medium which makes its way past the piston 50 out of the pumping chamber 46 in the direction of the actuating device 30. Above all, however, it additionally prevents the ingress of impurities, especially microbacterial impurities.

Figure 2A:
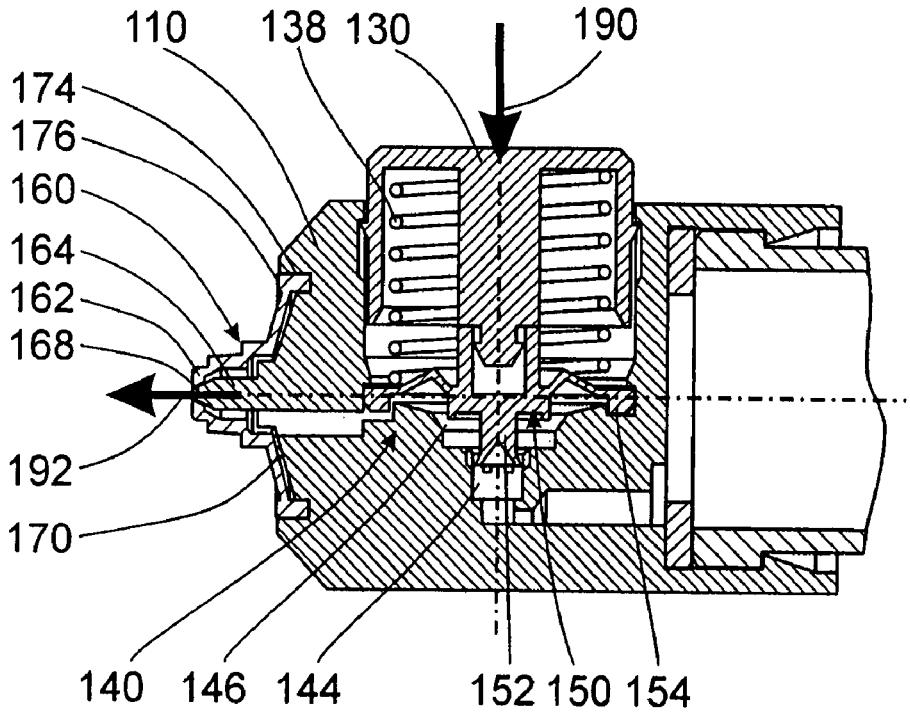
FIGS. 2*a* and 2*b* show a second embodiment of a discharger according to the invention in sectioned representations of two actuation states.
Figure 2B:
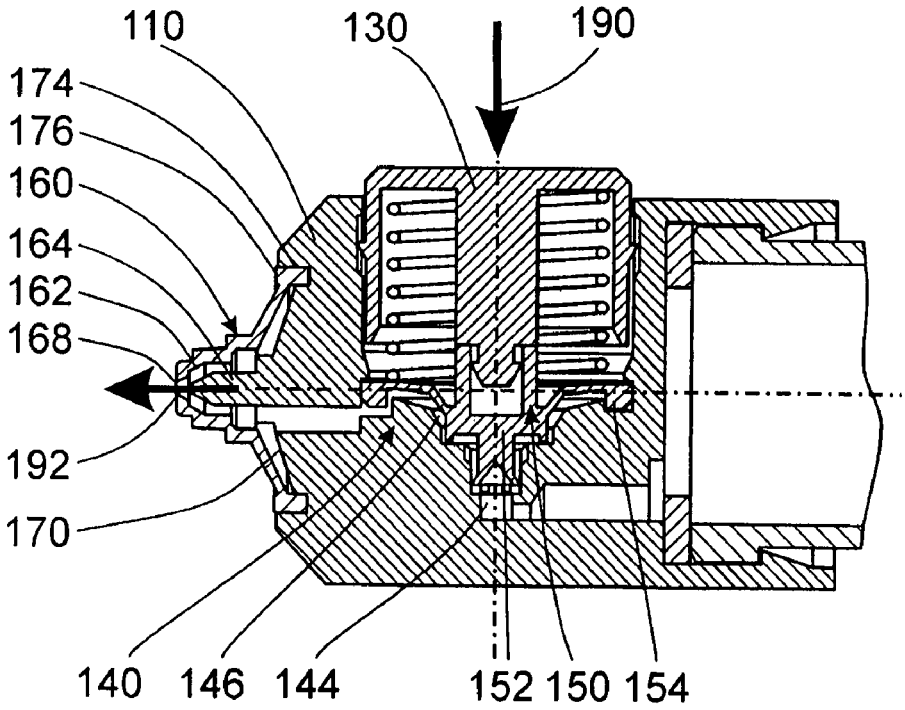

FIGS. 2*a* and 2*b* show a second embodiment of a discharger according to the invention in two different states, FIG. 2*a* showing a state prior to actuation of an actuating device 130 and FIG. 2*b* showing a state during the actuation of the actuating device 130.

The structure of the discharger of FIGS. 2*a* and 2*b* is in this case similar to the structure of the embodiment of FIG. 1. Once again, the discharger has a housing 110 comprising the actuating device 130 and a discharge valve unit 160. In the housing 110 there is a pumping device 140 having a piston 150, a pumping direction 190 of the piston, which simultaneously constitutes the motional direction of the actuating device 130, running perpendicular to a principal direction of extent 192 of the discharger, which corresponds to the discharge direction of the medium.

The differences relative to the embodiment of FIG. 1 lie, in particular, in the design of the piston 150 and the design of the discharge valve unit 160.

The piston 150 is configured as a flexible diaphragm, which, in a central region 152, is fixedly connected to the actuating device 130. The diaphragm is secured in the pumping device by its outer marginal region 154 and thus seals a thereby delimited pumping chamber 146 against the actuating device 130 and against impurities infiltrating the latter. Since the piston 150, because of the securement in the marginal region, is not suitable for closing off in the course of the piston stroke an inlet duct for medium, which inlet duct enters in the wall region of the pumping chamber 146, the inlet duct 144 is arranged such that it opens out on the end face, situated opposite the piston 150, of the pumping chamber 146. The piston 150 is shaped in its central region 152 such that it closes off this inlet duct 144 in the course of the actuation and thereby allows the build-up of the fluid pressure necessary for the discharge process.

The design of the discharge valve unit 160 comprises a closing pin 164, which is molded integrally onto the housing 110. Around the closing pin 164, on the surface of the housing, a circular groove 174 is provided, in which a marginal region 176 of an elastic discharge sleeve 162 is inserted. In dependence on the fluid pressure in a pressure chamber 170 between the housing 110 and the discharge sleeve 162, the discharge valve unit 160 opens by virtue of the opening-up of a discharge opening 168. The closed state is represented in FIG. 2*a*. The open state is represented in FIG. 2*b*.

If, starting from the initial state of FIG. 2*a*, the actuating device 130 is pressed in in the pumping direction 190, the piston 150 is also thereby forced into the pumping chamber 146, the marginal region 154 of the piston remaining immovably clamped in a housing-fixed manner and preventing impurities from infiltrating the pumping chamber 146. The central region 152 of the piston 150 is forced into the inlet duct 144 and closes this off against the pumping chamber 146. From a stroke position in which the inlet duct 144 is closed off, the progressive stroke movement of the piston leads to an increase in fluid pressure in the pumping chamber 146, the outlet duct and the pressure chamber 170. This increase in fluid pressure leads, in the manner described above, to an opening of the discharge valve unit 160, as represented in FIG. 2*b*. In a non-represented manner, the discharge sleeve returns, following discharge of the medium, into its original position and elastically relaxed original shape. The actuating device 130 is forced back into the original position by a restoring spring 138, an underpressure arising in the pumping chamber 146. Only once the central region 152 of the piston 150 opens up the inlet duct 144 again can medium again be sucked out of a medium container 180 into the pumping chamber 146 as a result of the created underpressure.

FIG. 3*a* to 3*d* show a third embodiment of a discharger according to the invention.

With respect to the basic structure with an actuating direction and a pumping direction 290 orthogonal to a principal direction of extent 292 of the discharger, this embodiment corresponds to the embodiments of FIGS. 1, 2*a* and 2*b*. With respect to the hermetic sealing of a pumping chamber 246 by means of a semispherical diaphragm 234 which is constructed in one piece with an actuating device 230, it corresponds to the embodiment of FIG. 1. The peculiarity of this embodiment lies in a special design of the pumping device 240 with regard to the activation. In addition to a first piston 250 which is fixedly connected to the hermetically sealing actuating device 230, this third embodiment has an opposed piston 260, which is disposed on the opposite side of the pumping chamber 246. This is pressurized by a spring force of an opposed piston spring 264 in the direction of an upper limit position and of the first piston 250. The opposed piston 260 is guided by means of an opposed piston guide 262, which limits its freedom of movement between the upper limit position, in which an outlet duct 256, up to a discharge opening 268, is separated from the pumping chamber 246, and a lower limit position in which the outlet duct 256 is connected to the pumping chamber 246. This structure allows a particularly advantageous ventilation of the pumping chamber 246 in the course of the activation. This is described below with reference to the process of FIG. 3*a* to 3*d*.

Figure 3A:
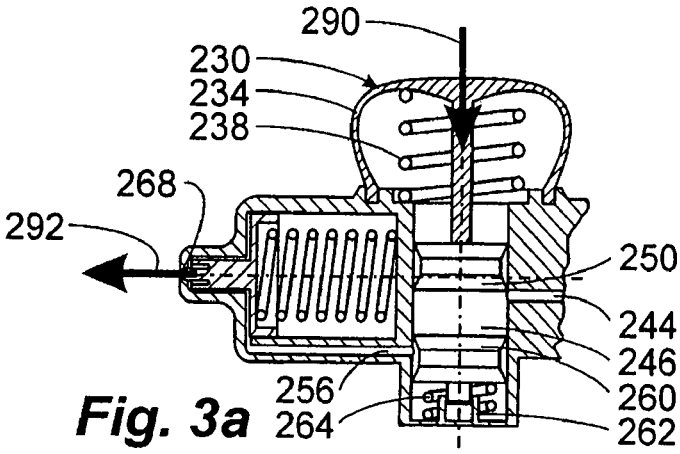
FIG. 3*a* to 3*d* show a third embodiment of a discharger according to the invention in sectioned representations of four activation states of the discharger.

FIG. 3*a* shows the delivery state in which the pumping chamber 246 is fully filled with air. The first piston 250 is forced by a restoring spring 238 into its upper limit position.

The opposed piston 260 is forced by the opposed piston spring 264 likewise into its upper limit position, so that the pumping chamber 246 is separated from the outlet duct 256.

Figure 3B:
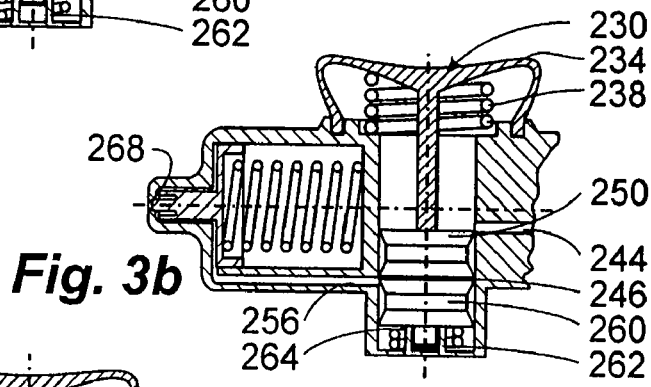

Starting from this initial position, the first piston 250 is manually forced downward by means of the actuating device 230. The diaphragm 234 is hereupon elastically deformed, at the same time as the hermetic sealing of the pumping chamber 246 is maintained. After the first piston 250 has been moved past an inlet duct 244, the pumping chamber 246 is outwardly sealed. In the course of the further movement, the air in the pumping chamber 246 is compressed to the point where the air pressure is sufficiently high to force the opposed piston 260 counter to the spring force of the opposed piston spring 264 in the direction of its lower limit position. As soon as the opposed piston 260, as is represented in FIG. 3*b*, makes its way into the region of the outlet duct 256, the compressed air escapes from pumping chamber 246. As soon, also, as the first piston 250 has reached the rim of the outlet duct 256, the pumping chamber is completely empty. Forced upward by the force of the opposed piston spring 264, the opposed piston 260 is pressed flush against the first piston 250, so that the volume of the pumping chamber 246 is approximately zero in this state.

Figure 3C:
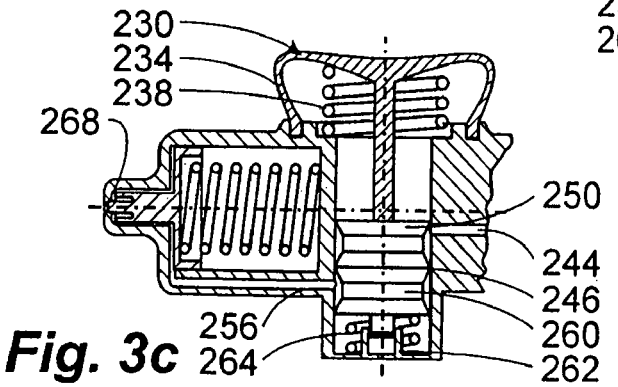

During the return stroke of the piston 250, the opposed piston 260 remains pressed flush against the piston 250 until such time as the opposed piston 260 has reached its upper limit position, which is defined by the limit of the opposed piston guide 262. From this position, which is represented in FIG. 3*c*, the pumping chamber volume 246 re-enlarges in the course of the continued return stroke of the first piston 250, whereupon a strong underpressure is created in the pumping chamber 246. As soon as the first piston 250 has arrived back in the region of the inlet duct 244, medium is therefore abruptly sucked out of a medium container (not represented) through the inlet duct 244 into the pumping chamber 246.

Figure 3D:
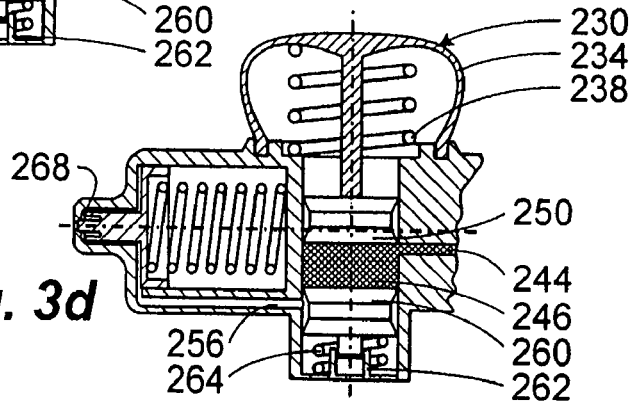

This state with filled pumping chamber 246 is represented in FIG. 3*d*. Starting from this state, the discharger can be used in a prescriptively correct manner.

FIG. 4*a* to 4*d* show a fourth embodiment of a discharger according to the invention. In this fourth embodiment, the transverse arrangement of a pump in the discharger corresponds to the first three embodiments.

The peculiarity of this fourth embodiment lies in a specially designed pumping device 340. A pumping chamber 346 is delimited on an end face 340A by a piston 350. The side wall of the pumping chamber is formed by a bellows 347. This bellows 347 is secured by its marginal region 354 in the housing on the side facing away from the piston, so that the pumping chamber 346 which is closed off by it remains free from impurities which infiltrate the housing in the region of the piston 350. On the end face situated opposite the piston 350, a medium inlet duct 344 and a medium outlet duct 356 open out into the pumping chamber 346, an inlet valve 330 having a valve slide 332 being provided on the inlet duct 344. The valve slide 332 is provided as a hollow cylinder which is closed on one side and on the open bottom side of which a circumferential latching edge 334 extends inward, which latching edge prevents the valve slide 332 from sliding off a cylindrical attachment 345 of the inlet duct 344. Corresponding to the valve slide 332, molded onto the piston 350 is an actuating pin 351, which extends in a pumping direction 390 and is disposed above an outer edge of the closed side of the valve slide 332.

The represented pumping device 340 allows a good ventilation of the pumping chamber 346 in the course of the activation of the discharger. The activation is explained below with reference to FIG. 4*a* to 4*d*.

Figure 4A:
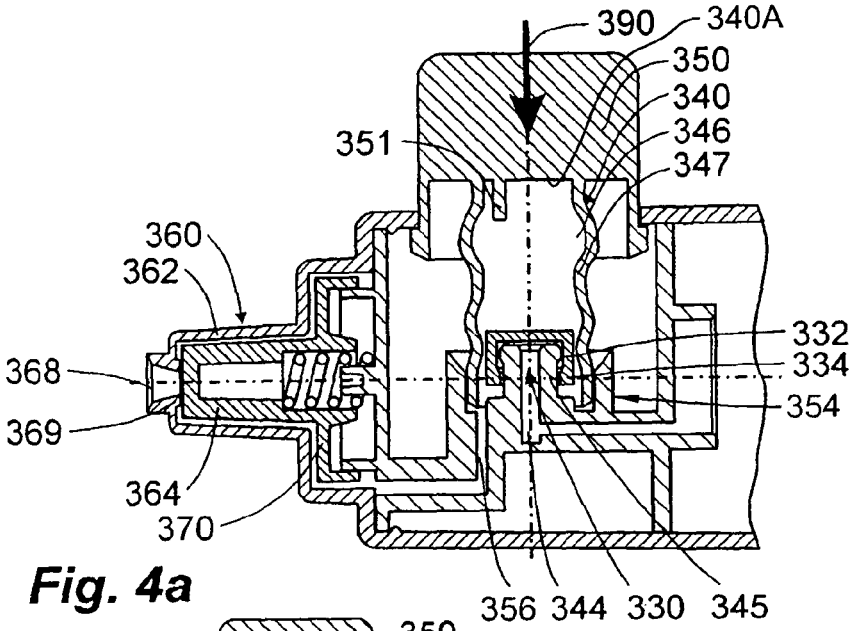
FIG. 4*a* to 4*d* show a fourth embodiment of a discharger according to the invention in sectioned representations of four activation states.
Figure 4B:
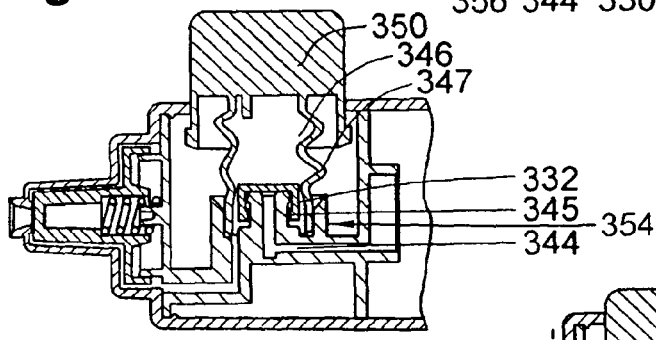
Figure 4C:
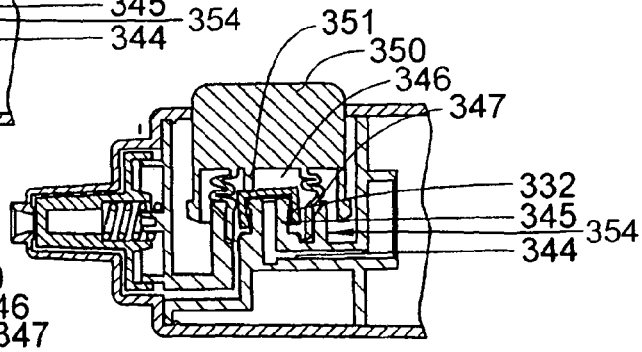
Figure 4D:
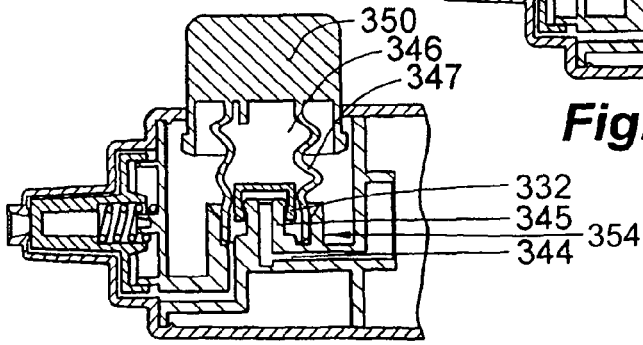

FIG. 4*a* shows an initial position of the discharger. In this delivery state, the pumping chamber 346 has its maximum volume and is filled with air. Starting from this state, the piston 350, which simultaneously constitutes an actuating device, is forced downward in the pumping direction 390. This results in an increase in air pressure in the pumping chamber, with the result that the valve slide 332 slips downward on the attachment 345 of the inlet duct 344 and thus closes off the inlet duct 344, as represented in FIG. 4*b*. In the course of the continued stroke movement of the piston 350, the air in the pumping chamber 346 is further compressed until the actuating pin 351 reaches the valve slide 332. As a result of the eccentric force which the actuating pin 351 exerts upon the valve slide, the latter—as is represented in FIG. 4*c*—is tilted, so that the inlet duct 344 is opened and the overpressurized air can escape from the pumping chamber 346. As is represented in FIG. 4*d*, the medium then, during the return stroke, makes its way out of a medium container (not represented) through the inlet duct 344 into the pumping chamber, after the valve slide 332 has been removed from the inlet duct owing to the underpressure in the pumping chamber 346 in the course of the return stroke. The medium which has got into the pumping chamber can then, upon the subsequent actuation of the piston 350, be discharged through the discharge opening 368 of the discharge valve unit 360, the valve slide 332 ensuring, in this normal operation also, that the inlet duct 344 is closed for the pressure build-up in the pumping chamber 346. Insofar as, in such a stroke movement in normal operation, in the lower limit position, the inlet duct 344 is opened by the actuating pin 351, the remaining medium escapes from the pumping chamber 346 back into the medium container.

The invention claimed is:

1. A discharger for a flowable medium comprising:

a housing having a discharge opening;

a pumping device disposed in said housing and having a pumping chamber;

a piston disposed adjacent a first side of said pumping chamber and being movable relative to said housing;

a gas-impermeable and flexible diaphragm defining part of said pumping chamber and hermetically sealing said pumping chamber on said first side from an environmental atmosphere outside said discharger, said diaphragm having a marginal region fixedly connected to said housing;

an inlet duct in communication with said pumping chamber and with a supply of medium;

an inlet valve disposed in said pump chamber, said inlet valve movably disposed on said inlet duct for opening and closing said inlet duct;

an outlet duct in communication with said discharge opening and with said pumping chamber, said inlet duct and said outlet duct both being disposed on a second side of said pumping chamber opposite said first side; and an actuating element disposed adjacent said first side of said pumping chamber and operatively connected to said piston and movable with said piston toward said inlet duct, said actuating element contacting said inlet valve to open said inlet duct as said piston moves toward said inlet duct.

2. The discharger according to claim 1, wherein the diaphragm is connected to the piston.

3. The discharger according to claim 2, wherein the diaphragm is configured in one piece with the piston.

4. The discharger according to claim 1, wherein the piston is movable in a piston direction which forms a right angle with a principal direction of extent of the discharger.

5. The discharger of claim 1, wherein said first side of said pumping chamber is defined by an end face of said piston.

6. The discharger of claim 5, wherein said actuating element is connected to said end face of said piston and extends into said pumping chamber.

7. The discharger of claim 5, wherein said piston and said actuating element are movable relative to said housing along a pumping axis which is transverse to a longitudinal axis of said discharger, and said pumping chamber extends along the pumping axis between said end face of said piston and said inlet duct and extends along the pumping axis between said end face of said piston and said outlet duct.

8. The discharger of claim 1, said inlet valve having a valve slide.

* * * * *